US006840312B1

(12) United States Patent
Sandberg

(10) Patent No.: US 6,840,312 B1
(45) Date of Patent: Jan. 11, 2005

(54) COOLING ELEMENT FOR A HEATER EXCHANGE

(75) Inventor: Per Sandberg, Västerås (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/914,886

(22) PCT Filed: Feb. 23, 2000

(86) PCT No.: PCT/FI00/00145

§ 371 (c)(1),
(2), (4) Date: Jan. 7, 2002

(87) PCT Pub. No.: WO00/55560

PCT Pub. Date: Sep. 21, 2000

(30) Foreign Application Priority Data

Mar. 16, 1999 (FI) ..... 990576

(51) Int. Cl.[7] ..... F28F 1/30; F28F 1/32; F28F 1/34

(52) U.S. Cl. ..... 165/152; 165/153

(58) Field of Search ..... 165/151–153; F28F 1/30, 1/34

(56) References Cited

U.S. PATENT DOCUMENTS

| | | | | | |
|---|---|---|---|---|---|
| 1,454,107 | A | * | 5/1923 | Curran | 165/153 |
| 1,458,128 | A | * | 6/1923 | Curran | 165/153 |
| 3,250,325 | A | | 5/1966 | Rhodes et al. | |
| 4,469,168 | A | * | 9/1984 | Itoh et al. | 165/152 |
| 4,657,070 | A | * | 4/1987 | Kluppel | 165/124 |
| 5,035,052 | A | | 7/1991 | Suzuki et al. | |
| 5,501,270 | A | | 3/1996 | Young et al. | |
| 6,125,926 | A | * | 10/2000 | Okamoto et al. | 165/152 |

FOREIGN PATENT DOCUMENTS

| | | | | | |
|---|---|---|---|---|---|
| GB | 2027533 | A | * | 2/1980 | 165/151 |
| JP | 48-27263 | | * | 8/1973 | |
| JP | 55110892 | A | * | 8/1980 | F28F/1/30 |
| JP | 55118596 | A | * | 9/1980 | F28F/1/32 |
| JP | 56142394 | A | * | 11/1981 | F28F/1/30 |
| JP | 58047992 | A | * | 3/1983 | F28F/1/30 |
| JP | 58066793 | A | * | 4/1983 | F28F/1/30 |
| JP | 58178192 | A | * | 10/1983 | F28F/1/30 |
| JP | 59104094 | | * | 6/1984 | F28F/1/30 |
| JP | 59212693 | A | * | 12/1984 | F28F/1/30 |
| JP | 61052589 | A | * | 3/1986 | F28F/1/32 |
| JP | 01169294 | A | * | 7/1989 | F28D/1/047 |
| JP | 2000039282 | A | * | 2/2000 | F28F/1/30 |

* cited by examiner

*Primary Examiner*—Leonard R. Leo
(74) *Attorney, Agent, or Firm*—Smith-Hill and Bedell

(57) ABSTRACT

The invention relates to a cooling element provided with louvers to be used in a heat exchanger under the influence of passing cooling medium used for cooling another medium flowing inside a circulating element whereto the cooling element is bounded by a contact area on one edge, and the louvers form an angle with the surface of the cooling element. According to the invention the cooling element is positioned so that the cooling element forms a substantially equal angle to the longitudinal direction of the circulating element as the louvers form to the surface of the cooling element.

12 Claims, 3 Drawing Sheets

COOLING ELEMENT FOR A HEATER EXCHANGE

Figure 1:
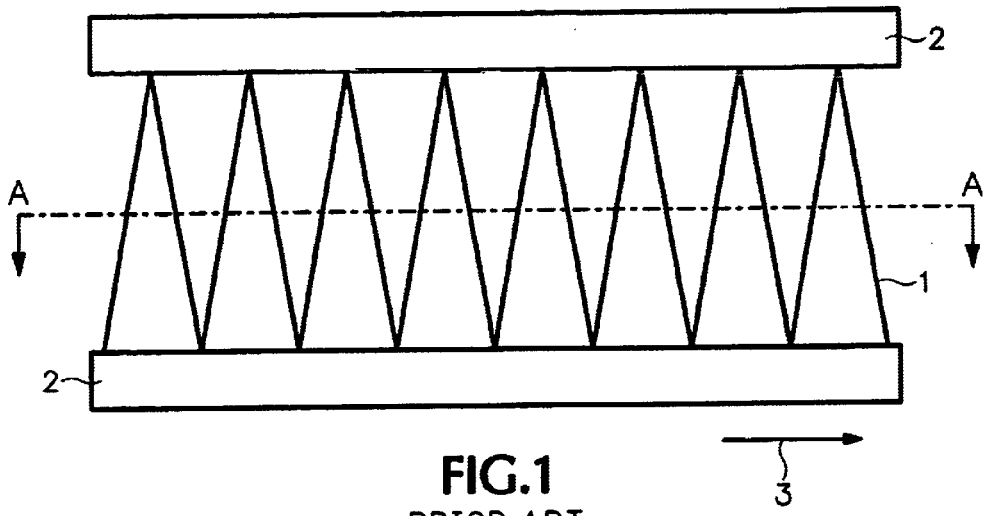
FIG.1 PRIOR ART

The invention relates to a cooling element provided with louvers to be used in a heat exchanger, particularly in a heat exchanger constructed so that the cooling element is under the influence of passing cooling medium, as air or water, used for cooling another medium flowing inside a circulating element and that the cooling element is used as a connecting member for two circulating elements.

In heat exchangers used in automotive industry for cooling a motor in a vehicle, a fin is generally made of a corrugated strip. The corrugated strip itself is made of copper, copper-based alloy or aluminium or aluminium-based alloy and this corrugated strip is installed between circulating elements where medium to be cooled is circulated. The corrugated strip has a strong metallic bond with these circulating elements of medium to be cooled. The metallic bond is made by a braze or a solder material. One corrugated strip creates many cooling elements, fins, between circulating elements and the fins are provided with louvers for improving heat transfer capacity. Further, the fins positioned between two circulating elements are installed substantially perpendicularly to the longitudinal direction of the fin strip. When these kind of fins are cut in the middle between the two circulating elements, each individual fin has a number of louvers twisted at an angle of 20 to 45 degrees and grouped together in even numbers of different areas. Every odd area has the louvers at its angle and even areas at the opposite angle. The louvers are very small, from 0.75 to 1.5 millimeter, but the louvers are very efficient for the heat transfer capacity.

When cooling medium, as air or water, is passing the fins, cooling medium is forced to flow in accordance with a flow pattern defined by the louvers. At low cooling medium flow levels, the flow has in spite of louvers space enough to go directly through the fins. On the contrary, at moderate or high cooling medium flow levels, the flow has to be redirected several times when passing the fins. This means more costs because of energy loss and this effect can be measured as a higher pressure drop over the heat exchanger.

The object of the present invention is to eliminate some drawbacks of the prior art and to achieve a cooling element to be used in a heat exchanger, particularly in a heat exchanger where the cooling element, as a fin, is a connecting member between two circulating elements so that the redirections of a cooling medium as well as a pressure drop are substantially eliminated. The essential novel features of the invention are apparent from the appended claims.

In accordance with the invention a cooling element, as a fin, in a heat exchanger is provided with louvers in order to improve heat transfer capacity in the heat exchanger. The fin is positioned between circulating elements of the heat exchanger so that a cooling medium, as air or water, passes the fin, and the fin will further cool the circulating elements where another medium to be cooled flows. The fin is bond by a contact area on one edge to a circulating element, and the louvers form an angle with the surface of the fin. The fin is installed between the two circulating elements so that the fin forms essentially the same angle towards the longitudinal direction of the circulating element as the louvers form towards the surface of the fin. This kind of a fin arrangement eliminates redirections at moderate or high cooling medium flow levels, because the louvers are essentially in the same direction as the flow direction of the cooling medium when entering the heat exchanger. For high heat transfer capacity several fins are installed between two circulating elements.

The fins are installed between circulating elements so that between the fins and the circulating element there is advantageously a strong bond made of a brazing or soldering material in the area where the fin and the circulating element have a contact with each other. The fins are installed so that at least on the contact area with the circulating elements the fins are advantageously essentially parallel to each other. In this contact area the fin forms an acute angle towards the longitudinal direction of the circulating element. The acute angle is in the range of 20 to 45 degrees, advantageously in the range of 25 to 35 degrees. The angle of the fin towards the longitudinal direction of the circulating element is dependent on the angle of the louvers to the surface of the fin. This is because these two angles are substantially the same in largeness.

The fins can be positioned to the contact area with the circulating elements so that the contact area with the circulating elements forms a shape of a straight line on its substantially whole length. The fins can also be positioned so that the contact area with the circulating elements forms a shape of a fraction line so that each part of the fraction line forms an substantially equal angle towards the longitudinal direction of the circulating element.

The fins are advantageously created by a corrugated strip which is installed between two circulating elements so that the folds of the strip have alternately a contact with one circulating element. The strip is further positioned so that in the contact area between the fold and the circulating element the folds are substantial parallel to each other and the folds form an acute angle towards the longitudinal direction of the circulating element.

The fin can also be a flat plate which has a connection between several circulating elements. In that embodiment the louvers are installed between the circulating elements so that a flow of cooling medium goes through the louvers when passing the flat plate shaped as a fin.

The fins and the corrugated strip for a creation of the fins are advantageously made of copper, a copper-based alloy, aluminium or an aluminium-based alloy.

Figure 2:
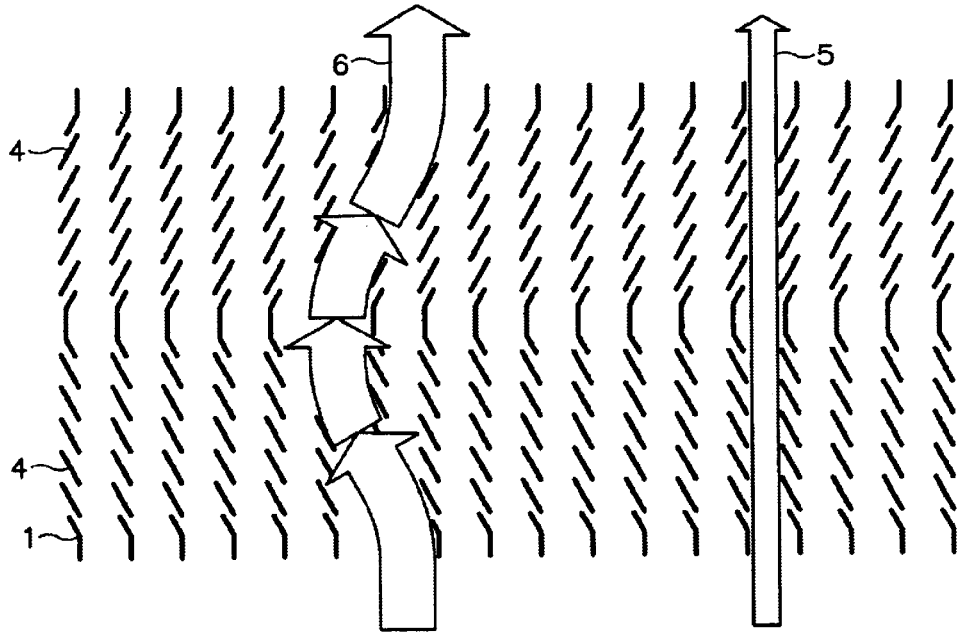
FIG.2 PRIOR ART
Figure 3A:
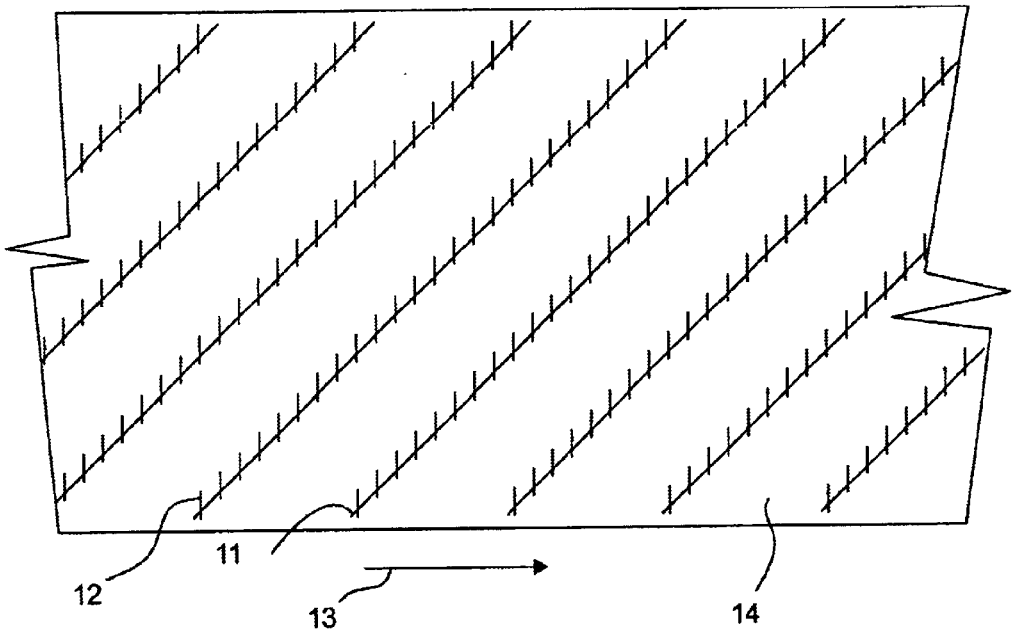
Figure 3B:
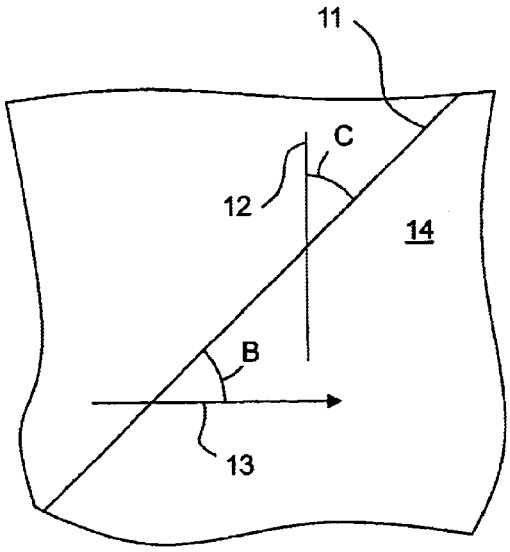
Figure 4:
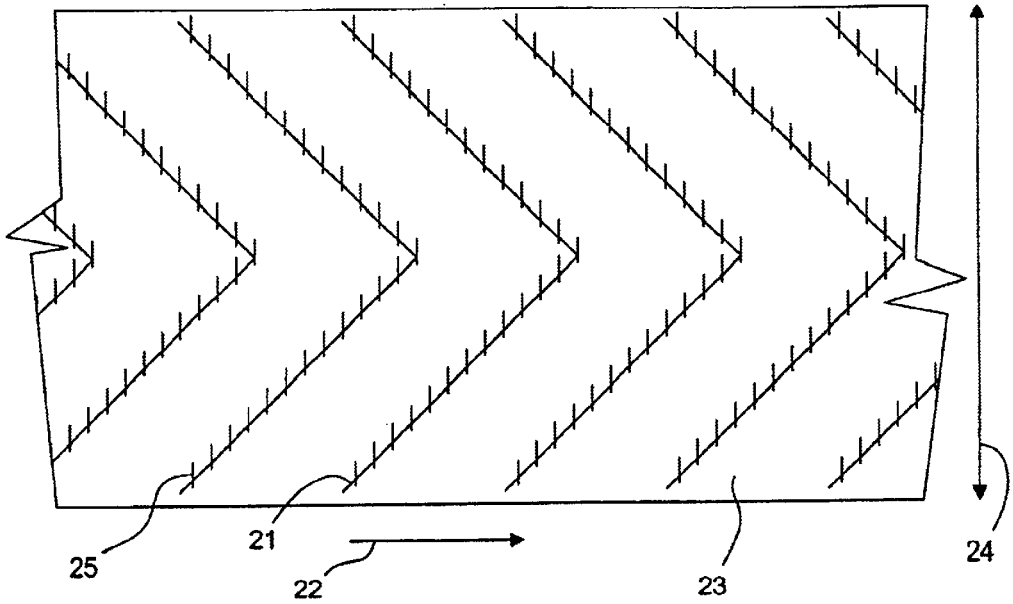

The invention is described in more detail with reference to the appended drawings, where FIG. 1 is a schematical side-view illustration of fins in the prior art, FIG. 2 is an illustration of FIG. 1 seen from the direction A—A, FIG. 3 is a schematical and partial top-view illustration of one embodiment of the invention, and FIG. 4 is a schematical and partial top-view of another embodiment of the invention.

In accordance with FIGS. 1 and 2 the fins 1 are positioned between two circulating elements 2. The fins 1 are installed substantially perpendicular to the longitudinal direction 3 (shown as an arrow) of the circulating element 2. The fins 1 are provided with louvers 4. The louvers 4 will make curves for cooling medium passing the fins 1 shown as an arrow 6 for high cooling medium flow level, but not for low cooling medium flow level shown as an arrow 5.

In FIGS. 3*a* and 3*b* positions of louvers 12 in a fin 11 and the fin 11 to the longitudinal direction 13 (shown as an arrow) of a circulating element 14 are illustrated. An angle of a louver 12 to the direction of the fin 11 is essentially equal to an angle of a fin 11 to the longitudinal direction of the circulating element 14. The direction of the fin 11 is essentially the same in the essentially whole breadth 15 of the circulating element 14. The fins 11 are positioned substantially parallel to each other. FIG. 3*b* illustrates the angle B of one individual fin 11 relating to the circulating element 14 and the angle C of one individual louver 12 relating to the surface of the fin 11.

FIG. 4 illustrates an embodiment where a fin 21 with louvers 25 changes its direction to the longitudinal direction 22 (shown as an arrow) of a circulating element 23, but an angle to the circulating element 23 is essentially the same in the essentially whole breadth 24 of the circulating element 23.

What is claimed is:

1. A heat exchanger comprising:

first and second elongate circulating elements each having a longitudinal direction and each defining an interior space for conducting a flow of heat exchange medium in said longitudinal direction, and a cooling element having a surface and also having a contact area at one edge, wherein the cooling element is bonded at its contact area to the first circulating element and is provided with louvers that are disposed at a first predetermined acute angle to the surface of the cooling element, wherein the cooling element is part of a corrugated strip having alternating contact areas contacting the first and second circulating elements respectively, the cooling element in disposed at a second predetermined acute angle to the longitudinal direction of the first circulating element, and the first and second predetermined acute angles are substantially equal in magnitude.

2. A heat exchanger according to claim 1, wherein the magnitude of the second predetermined acute angle is in the range from 20 to 45 degrees.

3. A heat exchanger according to claim 1, wherein the contact area is substantially rectilinear over substantially its entire length.

4. A heat exchanger according to claim 1, wherein the cooling element is made of copper, a copper-based alloy, aluminum, or an aluminum-based alloy.

5. A heat exchanger according to claim 1, wherein the cooling element is a fin.

6. A heat exchanger according to claim 5, wherein the fin is disposed at an angle 45° to the longitudinal direction of the first circulating element and cooling medium enters the heat exchanger in a direction substantially parallel to the louvers.

7. A heat exchanger comprising:

first and second elongate circulating elements each having a longitudinal direction and each defining an interior space for conducting a flow of heat exchange medium in said longitudinal direction, and a cooling element composed of first and second portions each having a surface and each also having a contact area at one edge, wherein each portion of the cooling element is bonded at its contact area to the first circulating element and is provided with louvers, the louvers of the first portion of the cooling element are disposed at a first predetermined acute angle to the surface of the first portion of the cooling element, and the louvers of the second portion of the cooling element are disposed at a second predetermined acute angle to the surface of the second portion of the cooling element, wherein the first portion of the cooling element is disposed at a third predetermined acute angle to the longitudinal direction of the first circulating element, the second portion of the cooling element is disposed at a fourth predetermined acute angle to the longitudinal direction of the first circulating element, and the first, second, third and fourth predetermined acute angles are substantially equal in magnitude.

8. A heat exchanger according to claim 7, wherein the magnitudes of the third and fourth predetermined acute angles are each in the range from 20 to 45 degrees.

9. A heat exchanger according to claim 7, wherein the contact areas of the first and second portions of the cooling element are each substantially rectilinear over substantially its entire length.

10. A heat exchanger according to claim 7, wherein the cooling element is made of copper, a copper-based alloy, aluminum, or an aluminum-based alloy.

11. A heat exchanger according to claim 7, wherein the cooling element is a fin.

12. A heat exchanger according to claim 11, wherein the fin is disposed at an angle 45° to the longitudinal direction of the first circulating element and cooling medium enters the heat exchanger in a direction substantially parallel to the louvers.

* * * * *